US010626612B2

(12) United States Patent
Yin et al.

(10) Patent No.: US 10,626,612 B2
(45) Date of Patent: Apr. 21, 2020

(54) JIG FOR MAKING REINFORCEMENT CAGE, METHOD FOR MAKING ASSEMBLY OF THE SAME AND ERECTING FRAME

(71) Applicant: RUENTEX ENGINEERING & CONSTRUCTION CO., LTD., Taipei (TW)

(72) Inventors: Samuel Yin, Taipei (TW); Kun-Jung Shu, Taipei (TW)

(73) Assignee: RUENTEX ENGINEERING & CONSTRUCTON, Co., Ltd., Taipei (TW)

( * ) Notice: Subject to any disclaimer, the term of this patent is extended or adjusted under 35 U.S.C. 154(b) by 0 days.

(21) Appl. No.: 15/813,269

(22) Filed: Nov. 15, 2017

(65) Prior Publication Data

US 2019/0085562 A1 Mar. 21, 2019

(30) Foreign Application Priority Data

Sep. 20, 2017 (TW) ..... 106132173 A

(51) Int. Cl.
*B25B 11/02* (2006.01)
*E04C 5/06* (2006.01)
(Continued)

(52) U.S. Cl.
CPC ..... *E04C 5/0604* (2013.01); *B21F 27/125* (2013.01); *E04B 1/215* (2013.01)

(58) Field of Classification Search
CPC ..... B21F 27/125; E04B 1/215; E04C 5/0604; Y10T 29/5397
(Continued)

(56) References Cited

U.S. PATENT DOCUMENTS 3,276,092 A * 10/1966 Pankow ..... B28B 21/06 138/176
3,592,243 A * 7/1971 Fukushima ..... B21F 27/122 140/112
(Continued)

FOREIGN PATENT DOCUMENTS

CN 101786130 A 7/2010
CN 103255925 A 8/2013
(Continued)

OTHER PUBLICATIONS

Chinese Office Action and Search Report dated Nov. 12, 2019, in corresponding Chinese patent application 201710849869.7, 5 pages in Chinese, 2 pages in English.

*Primary Examiner* — Joshua J Michener
*Assistant Examiner* — James J Buckle, Jr.
(74) *Attorney, Agent, or Firm* — Juan Carlos A. Marquez; Marquez IP Law Office, PLLC

(57) ABSTRACT

The present disclosure relates to a jig for manufacturing a reinforcement cage, which comprises a base member, a slot device disposed on the base member and extending along the lengthwise direction of the base member, and a plurality of fasteners arranged on a strip and spaced apart from each other along the lengthwise direction of the strip, wherein the strip is received in a slot of the slot device and is slidable within a predetermined range. The present disclosure further relates to an erecting frame for making a reinforcement cage assembly, which comprises a substantially square frame with four sides and a plurality of supports spaced apart from each other and disposed along the four sides, wherein each of the supports has at least one slot used for receiving and holding an end of a main bar of the reinforcement cage.

15 Claims, 19 Drawing Sheets

(51) Int. Cl.
*B21F 27/12* (2006.01)
*E04B 1/21* (2006.01)

(58) Field of Classification Search
USPC ..... 52/698; 269/13
See application file for complete search history.

(56) References Cited

U.S. PATENT DOCUMENTS 5,234,204 A * 8/1993 Hunt ..... B27M 3/0073 269/41
5,350,162 A * 9/1994 Cushing ..... B21F 27/125 269/13
6,223,785 B1 * 5/2001 Barden ..... B21F 27/124 140/112
6,560,834 B1 * 5/2003 Wirth ..... B21F 27/125 140/112
6,560,858 B1 * 5/2003 McAdoo ..... B23Q 1/032 269/910
6,817,090 B1 * 11/2004 McAdoo ..... B27F 7/155 227/152
9,115,492 B2 * 8/2015 Parham ..... E04C 5/168
2002/0157254 A1 * 10/2002 Wirth ..... B21F 27/125 29/897.34
2004/0261352 A1 * 12/2004 Bennett ..... E04C 5/20 52/698
2013/0074433 A1 * 3/2013 Ciuperca ..... E04B 1/355 52/426
2014/0021185 A1 * 1/2014 Anagnostopoulos ..... B21F 27/125 219/137 R

FOREIGN PATENT DOCUMENTS

CN 203817238 U 9/2014
CN 206052964 U 3/2017
JP H01214668 A 8/1989
JP H07252942 A 10/1995

* cited by examiner

JIG FOR MAKING REINFORCEMENT CAGE, METHOD FOR MAKING ASSEMBLY OF THE SAME AND ERECTING FRAME

BACKGROUND

1. Field of the Invention

The instant disclosure relates to a jig for manufacturing a reinforcement cage, an erecting frame for making a reinforcement cage assembly and methods for making a reinforcement cage and for making a reinforcement cage assembly.

2. Description of Related Art

A waffle slab is a reinforced concrete floor containing square grids, which is often used in construction projects needing intense strength to weight ratios and is a popular option for industrial building projects such as foundry plants. In particular, waffle slabs are often used as a floor of a clean room in a foundry plant. The clean room is for containing machinery and equipment and keeping the room free of contaminants that may affect operations of the machinery and equipment.

A reinforcement cage is used as a tension device in reinforced concrete structures, such as the above-mentioned waffle slabs, to strengthen and hold the concrete in tension. A reinforcement cage with stirrups can also increase shear strength of the reinforced concrete structures. A common process of assembling a reinforcement cage for a waffle slab requires temporarily holding the main bars in place at the scene before binding stirrups to the main bars to form the reinforcement cage. Equipment is required to calibrate levels and balance the bars to form the reinforcement cage. Such process is complicated and requires significant time, manpower and material resources.

Thus, there is a need in the art to devise a manner of forming a reinforcement cage for a waffle slab requiring less time, manpower and material resources.

SUMMARY OF THE INVENTION

The instant disclosure relates to a jig for manufacturing a reinforcement cage and an erecting frame for making a reinforcement cage assembly, which will shorten the time for making a reinforcement cage of a waffle slab.

According to one exemplary embodiment of the instant disclosure, a jig for manufacturing a reinforcement cage comprises: a base member; a slot device disposed on the base member and extending along a lengthwise direction of the base member; and a plurality of fasteners arranged on a strip and spaced from each other along the lengthwise direction of the strip, wherein the strip is received in the slot device and is slidable within a predetermined range. In another embodiment of the instant disclosure, the fasteners in the above embodiment are hooks. In a further embodiment, in addition to the features of the above embodiments, the jig further comprises: an elongated support arranged beside and above the slot device and generally parallel to the lengthwise direction of the slot device. In a further embodiment, in addition to the features of the above embodiments, the jig further comprises: a stopper disposed on the base member and adjacent to one end of the slot device. In a further embodiment, one end of the elongated support in the above embodiments is fixed to the stopper and the other end of the elongated support is fixed to the base member with a post. In a further embodiment, in addition to the features of the above embodiments, the jig further comprises: a plurality of pivoting members, which are rotatably mounted on the base member and spaced from each other along the lengthwise direction of the base member such that steel bars disposed on the slot device are capable of sliding along the lengthwise direction of the slot device.

According to another exemplary embodiment of the instant disclosure, a method for making a reinforcement cage comprises: providing a jig for manufacturing a reinforcement cage as described in the immediately preceding embodiment; providing a spiral stirrup on the slot device so that an edge of the spiral stirrup abuts against the elongated support; sliding the fasteners until each bottom of the spiral stirrup is engaged with each of the fasteners; providing at least one first main bar; and moving the first main bar through the pivoting members, from one end of the slot device that is near the post to the end that is near the stopper along the lengthwise direction of the slot device so that the first main bar passes through a central space of the spiral stirrup.

According to another exemplary embodiment of the instant disclosure, an erecting frame for making a reinforcement cage assembly comprises: a substantially square frame having a first side, a second side, a third side and a fourth side, wherein the first side and the third side are opposite each other and the second side and the fourth side are opposite each other; and a plurality of supports arranged along the four sides of the frame and spaced apart from each other; wherein the supports arranged at the first side correspond to the supports arranged at the third side, and wherein the supports arranged at the second side correspond to the supports arranged at the fourth side; and wherein each of the supports has at least one slot therein for receiving and fixing one end of a main bar of a reinforcement cage of the reinforcement cage assembly.

According to a further exemplary embodiment of the instant disclosure, a method for making a reinforcement cage assembly comprises: providing the erecting frame as described in the immediately preceding embodiment; providing a plurality of first reinforcement cages wherein each of the first reinforcement cages has at least one bottom main bar and a plurality of spiral stirrups fixed to the bottom main bar, and wherein the at least one bottom main bar has curved ends and preserved gaps are provided between the spiral stirrups; and respectively disposing two curved ends of the bottom main bar of the first reinforcement cages into the slots of the supports disposed at the second side and the fourth side, such that each of the first reinforcement cages is disposed within the erecting frame and substantially parallel to the first side or the third side.

In order to further understand the instant disclosure, the following embodiments are provided along with illustrations to facilitate appreciation of the instant disclosure; however, the appended drawings are merely provided for reference and illustration, without any intention to limit the scope of the instant disclosure.

BRIEF DESCRIPTION OF THE DRAWINGS

The aforementioned illustrations and following detailed descriptions are exemplary for the purpose of further explaining the scope of the instant disclosure. Other objectives and advantages related to the instant disclosure will be illustrated in the subsequent descriptions and appended drawings.

DETAILED DESCRIPTION OF THE PREFERRED EMBODIMENTS

Figure 1:
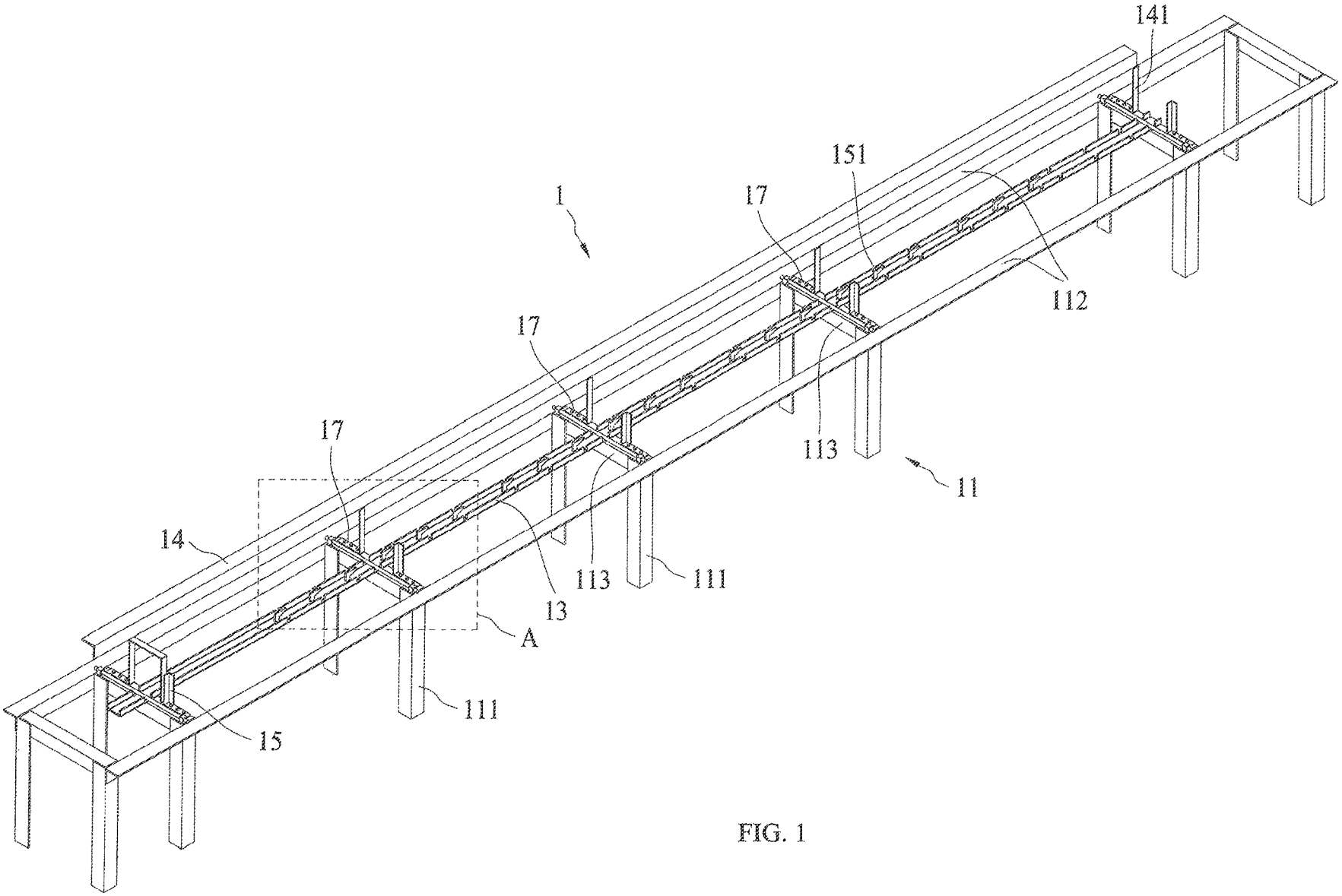
FIG. 1 is a perspective view of a jig for manufacturing a reinforcement cage in accordance with an embodiment of the instant disclosure.

FIG. 1 shows a jig 1 for manufacturing a reinforcement cage in accordance with an embodiment of the instant disclosure. The jig 1 has an elongated base member 11, wherein two rows of legs 111 are respectively arranged along a lengthwise direction and at two sides of the base member 11, and supports the elongated base member 11 on a ground wherein two first support members 112 are respectively connected to the tops of the two rows of legs 111, and wherein a plurality of second support members 113 are connected to each pair of the pairs of legs 111 and are transverse to the lengthwise direction of the base member 11. In another embodiment of the instant disclosure, the number of first support members 112 is more than two. A slot device 13 is disposed on the plurality of second support members 113 of the base member 11 and extends along the lengthwise direction of the base member 11. In another embodiment of the instant disclosure, the length of the slot device 13 could be equal to or larger than the length of the base member 11. Further, a stopper 15 is disposed on the base member 11 and adjacent to one end of the slot device 13. As shown in FIG. 1, an elongated support 14 is arranged beside and above the slot device 13 and is generally parallel to the lengthwise direction of the slot device 13. In this embodiment, one end of the elongated support 14 is fixed to the stopper 15 and the other end of the elongated support 14 is fixed to a post 141 disposed on the base member 11.

Figure 2:
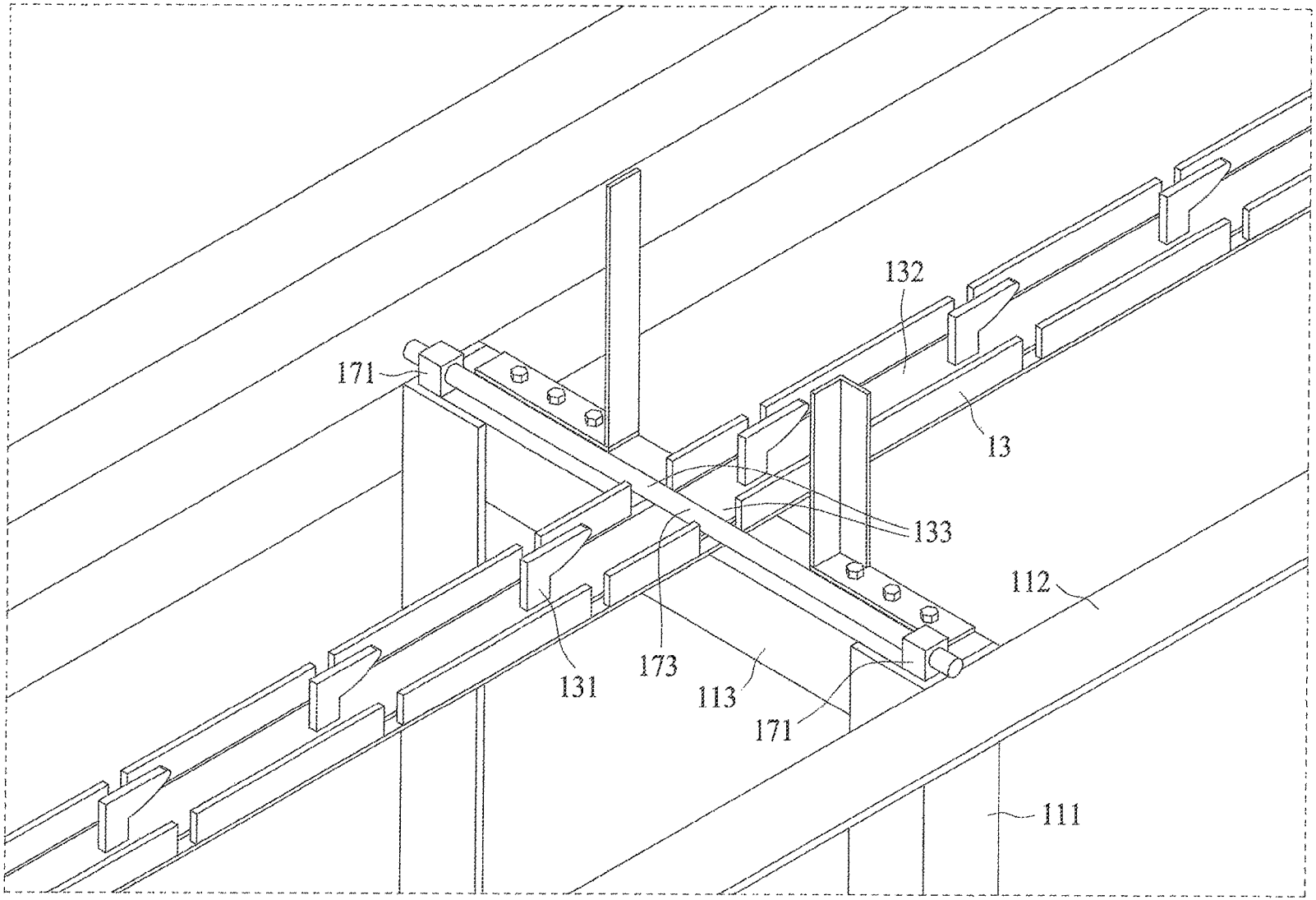
FIG. 2 is an enlarged view of portion "A" shown in FIG. 1.

FIG. 2 shows an enlarged view of portion "A" shown in FIG. 1. The slot device 13 has a strip 132 extending along the lengthwise direction of the slot device 13 and slidable within a predetermined range in the slot device 13. That is, the strip 132 is slidably disposed in a slot 139 of the slot device. Further, a plurality of hooks, which are used as the fasteners, are arranged on the strip 132 and spaced from each other along the lengthwise direction of the strip 132. When the strip 132 slides along the lengthwise direction of the slot device 13, the plurality of hooks 131 are moved with the strip 132.

In addition, the jig 1 for manufacturing the reinforcement cage comprises a plurality of pivoting members 17, which are rotatably mounted on the base member 11 and spaced from each other along the lengthwise direction of the base member 11. In particular, the position of each pivoting member substantially corresponds to the legs 111 of the base member 11. Referring to FIG. 2, the pivoting member 17 substantially spans the slot device 13 and has two pivoting bases 171 provided at its two ends. As shown in FIG. 2, two ends of a pivot axle 173 are pivotably received in the two pivoting bases 171. Each pivoting base 171 is arranged on the second support member 113 of the support post 111 of the base 11. The slot device 13 has two recesses 133 corresponding to the pivoting bases 171 such that the pivot axle 173 could be pivotably received in the two pivoting bases 171 and transversely spans the slot device 13.

Figure 3A:
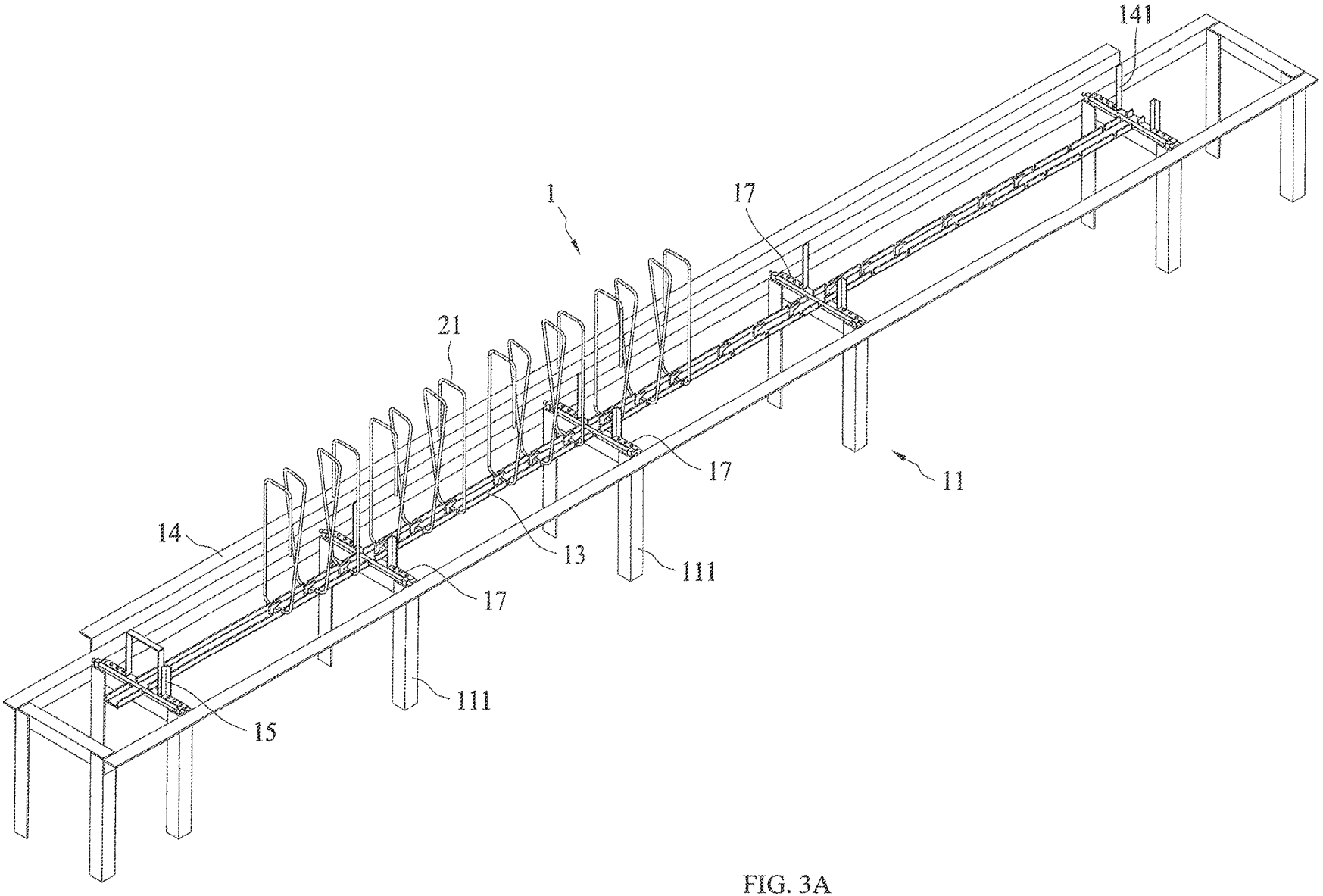
FIGS. 3A-3G are schematic views showing a method of manufacturing a reinforcement cage with the jig in accordance with an embodiment of the instant disclosure.
Figure 3B:
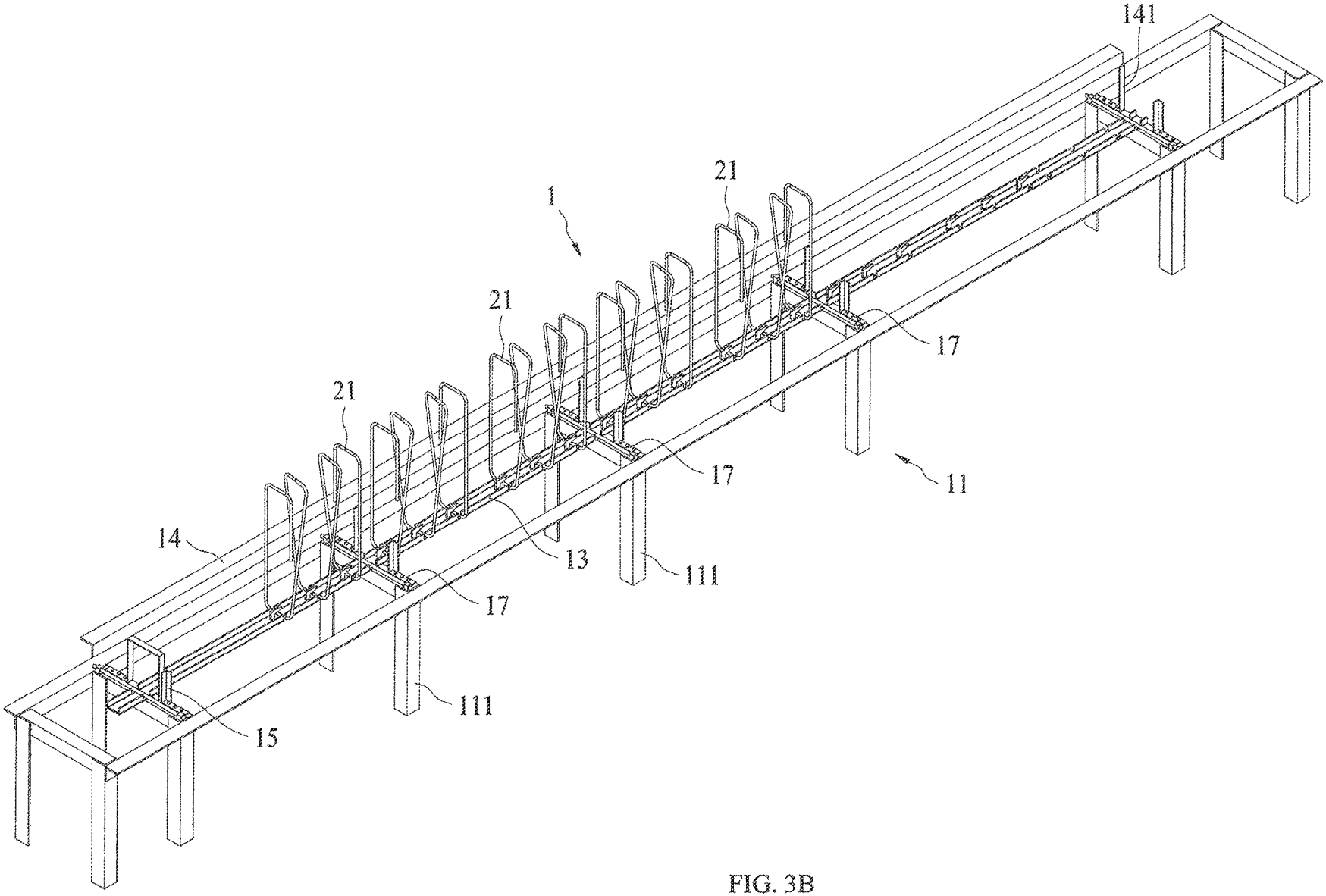
Figure 3C:
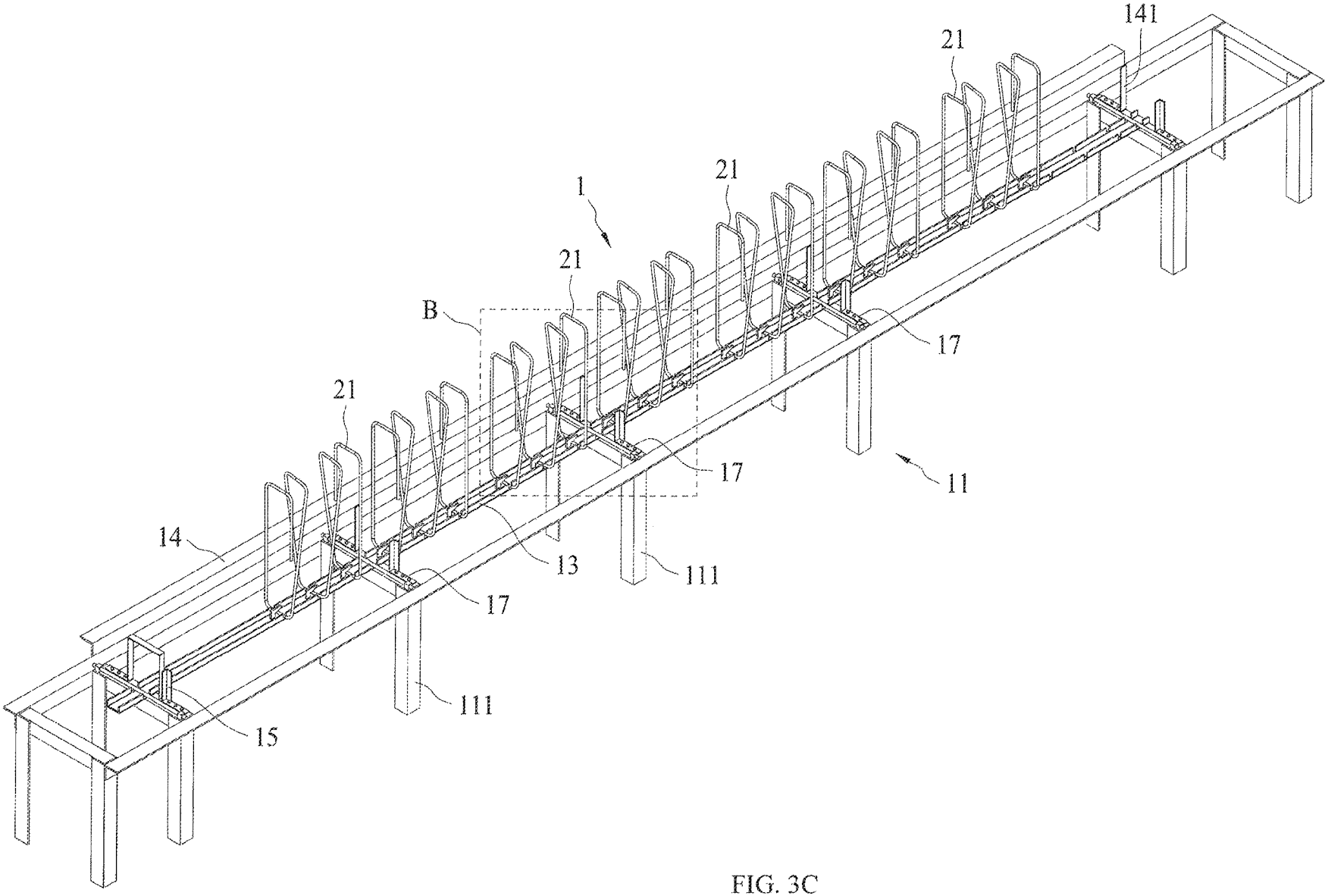
Figure 3D:
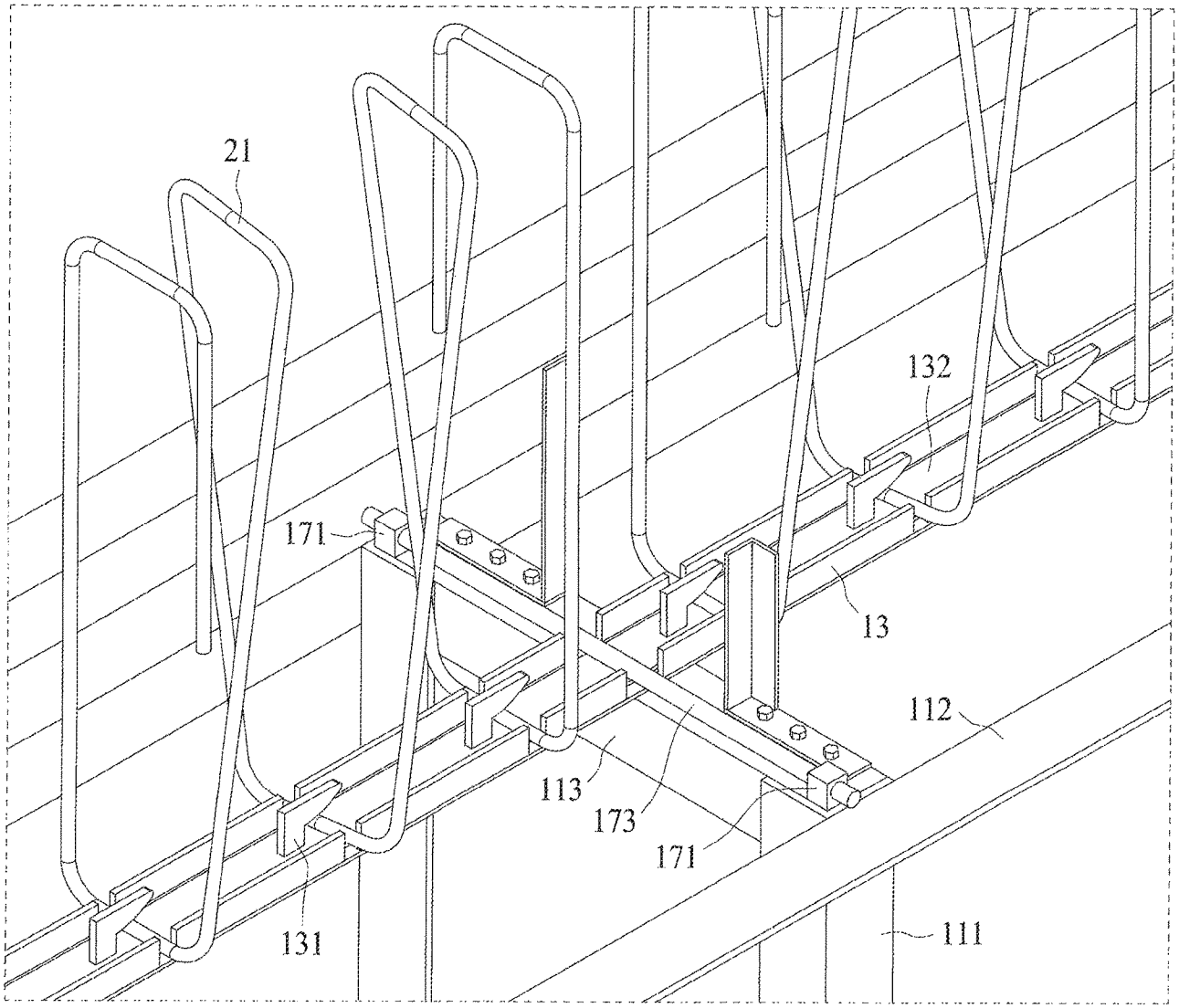
Figure 3E:
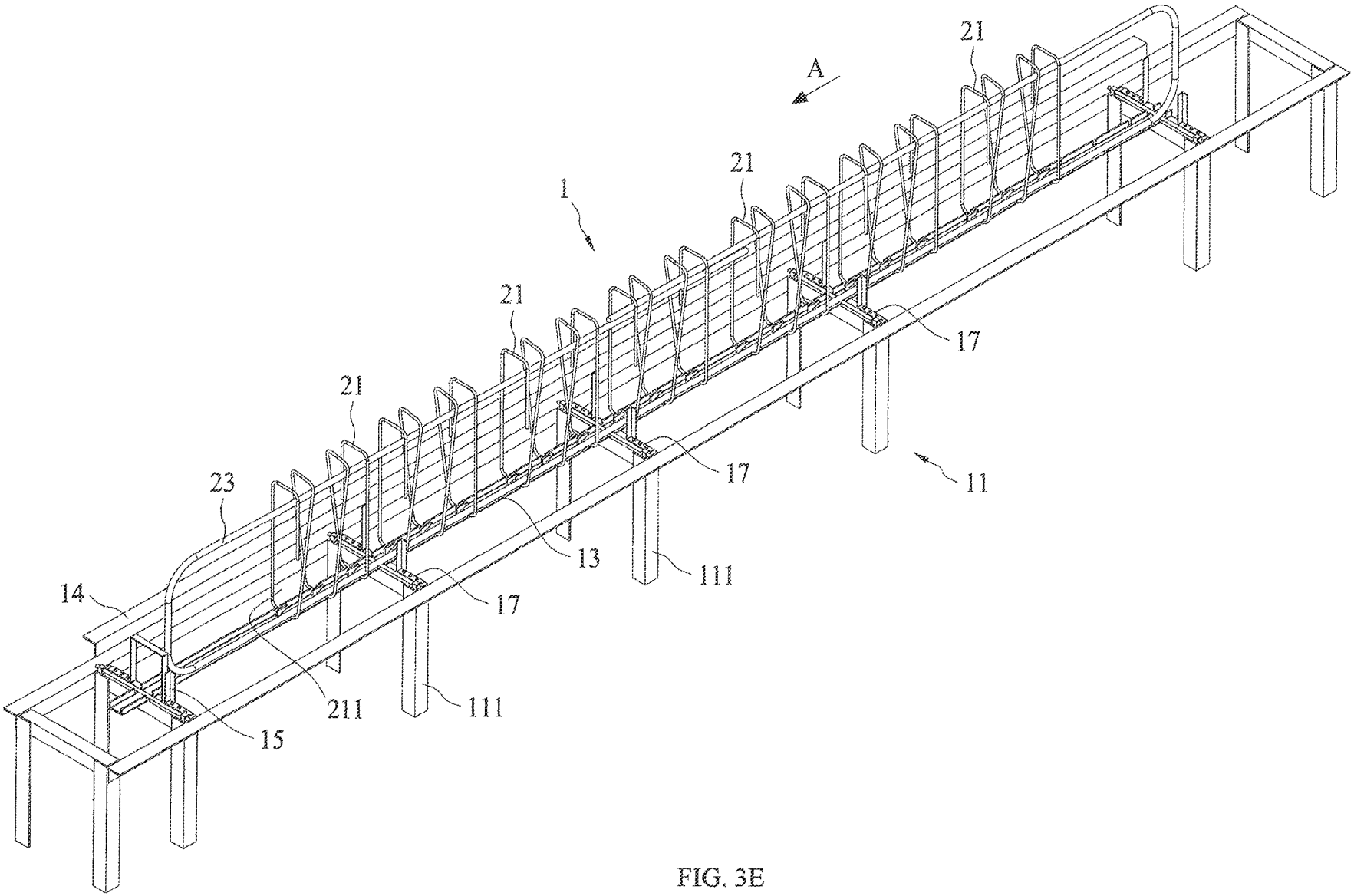
Figure 3F:
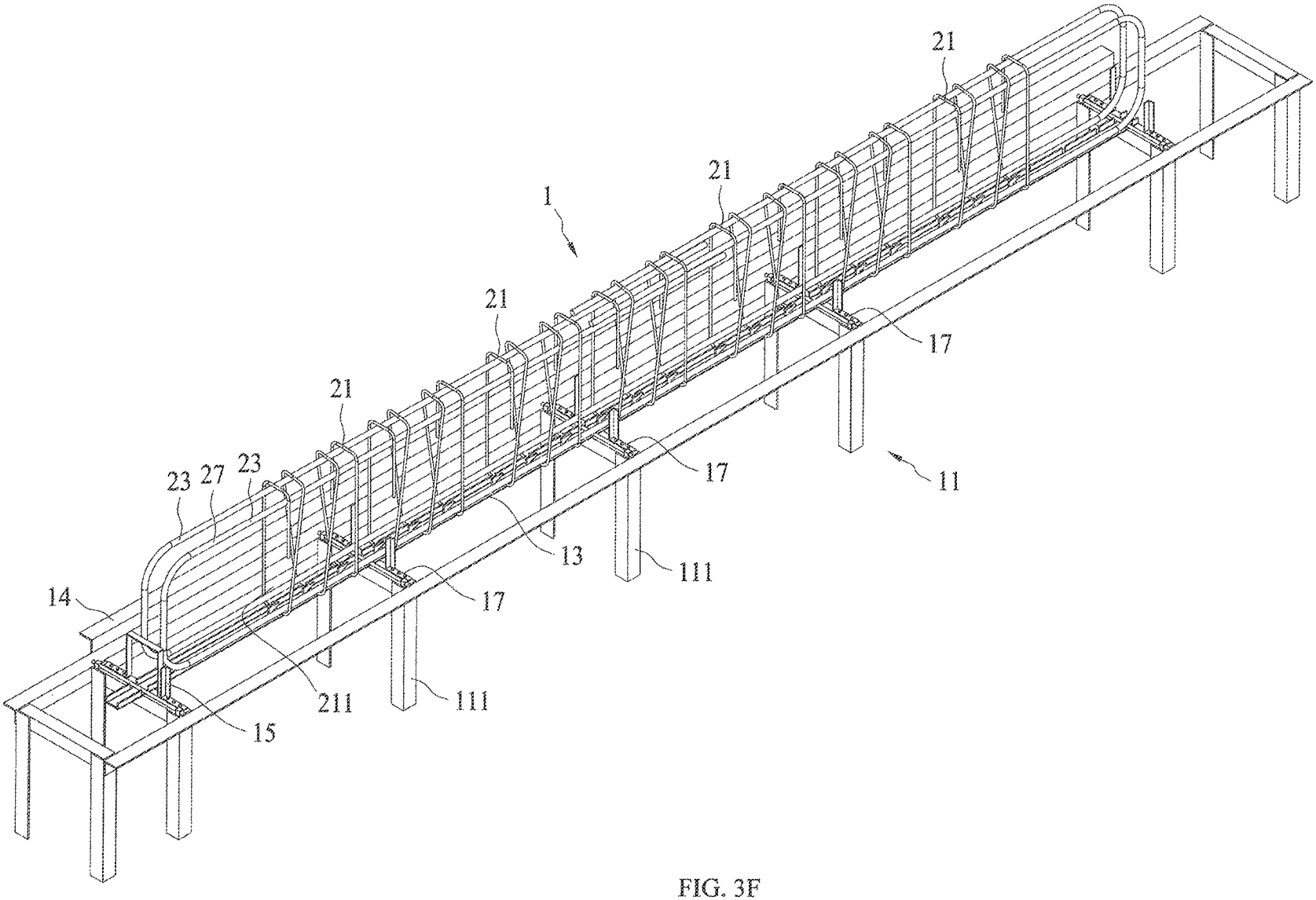
Figure 3G:
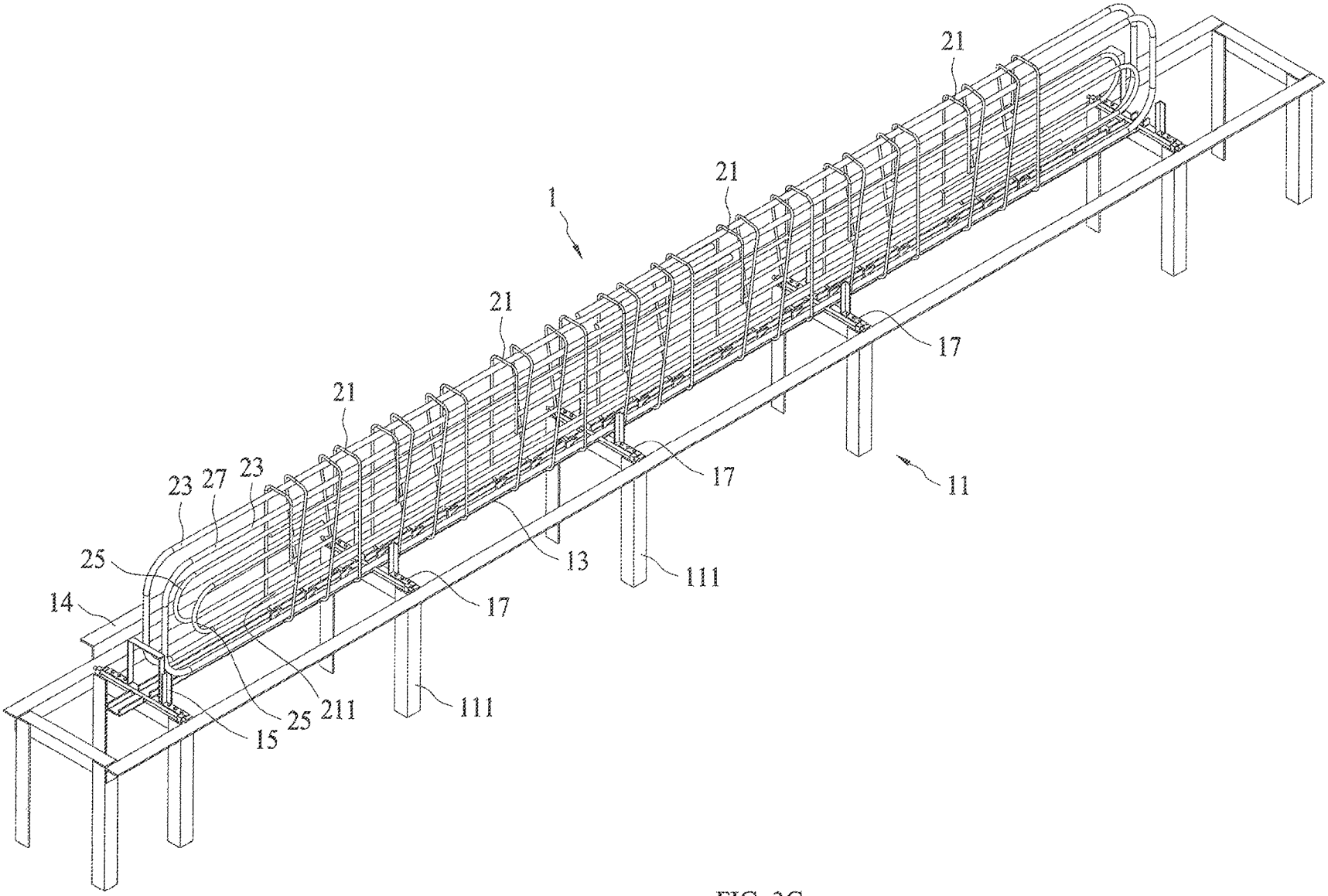

FIGS. 3A-3G are schematic views showing a method of manufacturing a reinforcement cage with the jig in accordance with an embodiment of the instant disclosure. As shown in FIGS. 3A-3C, the user places spiral stirrups 21 on the slot device 13 and along the lengthwise direction of the jig 1 such that a side of the spiral stirrups 21 abut against the elongated support 14. The user further slide the strip 131 to move the hooks 131 disposed on the strip 133 such that each bottom of the spiral stirrup 21 is engaged with each of the hooks 133 and thereby the spiral stirrups 21 are hooked to the jig (see FIG. 3D, which is an enlarged view of portion "B" shown in FIG. 3C). Preferably, square spiral stirrup 21 is used for the instant disclosure, but the spiral stirrup 21 with another shape is suitable for the instant disclosure as well. Further, referring to FIG. 3E, after the spiral stirrups 21 are secured to the base member 11 of the jig 1 with the hooks 133, the user moves a first main bar 23 from one end of the slot device 13 that is near the post 141 into a central space 211 of the spiral stirrups 21 (see the direction A in FIG. 3E). In this embodiment and as shown in FIGS. 3E-3G, the first main bar 23 is an elongated annular bar. When the first main bar 23 is entered into the central space 211 of the spiral stirrups 21, the first main bar 23 is passed through the central space 211 of the spiral stirrups 21 along the length of the slot device 13 with the aid of the pivoting members 17, and the first main bar 23 moves until it contacts the stopper 15. Moreover, as shown in FIG. 3F, the user further moves a second main bar 27 from one end of the slot device 13 that is near the post 141 into the central space 211 of the spiral stirrups 21. Likewise, the second main bar 27 is an elongated annular bar. The second main bar 27 is also passed through the central space 211 of the spiral stirrups 21 along the length of the slot device 13 with the aid of the pivoting members 17, and the second main bar 27 moves until it contacts the stopper 15. The second main bar 27 is arranged to be substantially parallel to the first main bar 23. In addition, as shown in FIG. 3G, the user further mover one or more tie bars 25 from one end of the slot device 13 that is near the post 141 into the central space 211 of the spiral stirrups 21. These tie bars 25 are passed through the central space 211 of the spiral stirrups 21 along the length of the slot device 13 until they contact the stopper 15. These tie bars 25 are substantially parallel to the first main bar 23 and the second main bar 27. In this embodiment, the tie bar 25 is an elongated annular bar and its size and diameter are smaller than the size and diameter of the first main bar 23 and the second bar 27. After the tie bars 25 are arranged in the central space 211 of the spiral stirrups 21, the user binds the tie bars 25, the spiral stirrups 21, the first main bar 23 and the second main bar 27 together so as to form a reinforcement cage.

Figure 4:
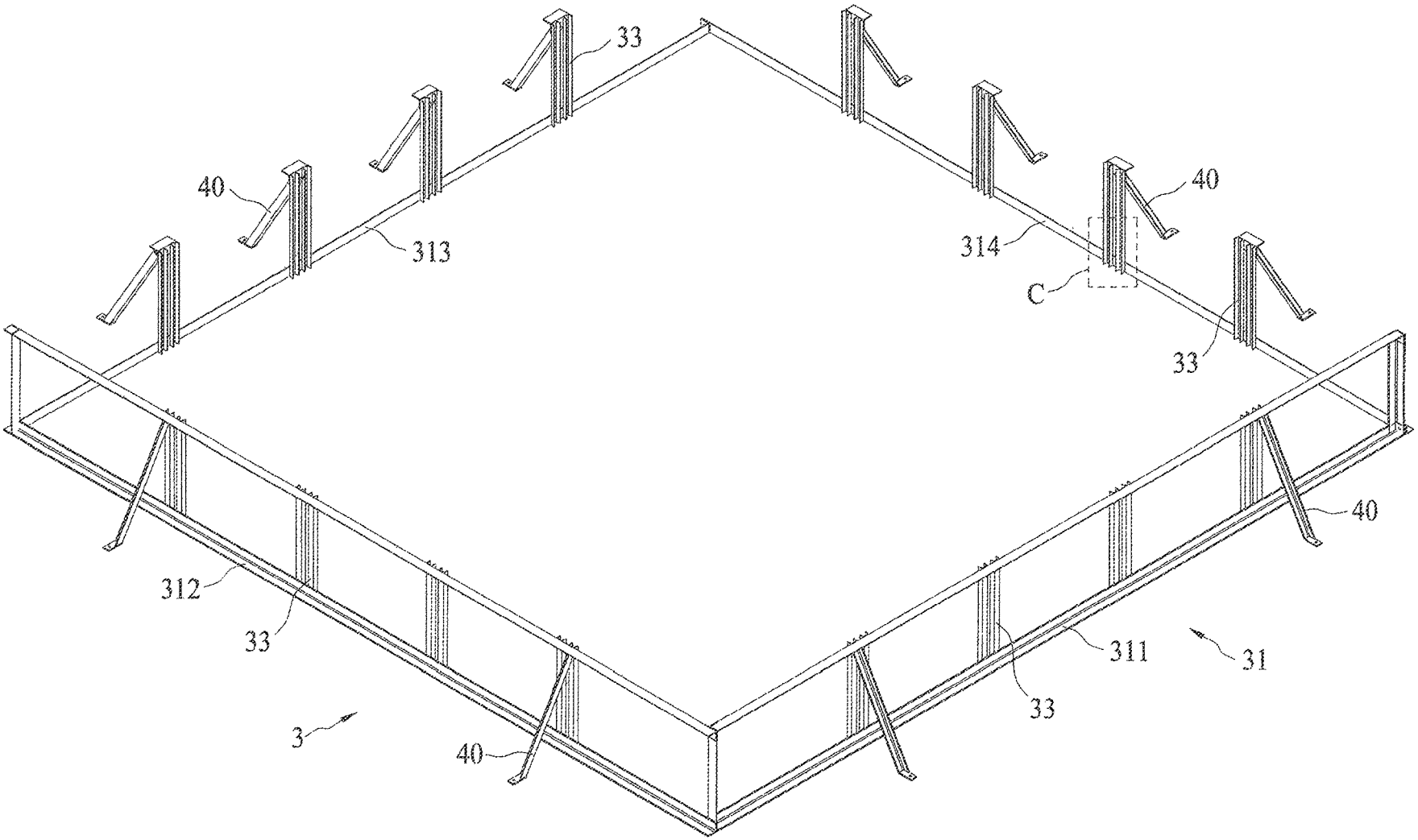
FIG. 4 is a perspective view of an erecting frame for making a reinforcement cage assembly in accordance with an embodiment of the instant disclosure.
Figure 5:
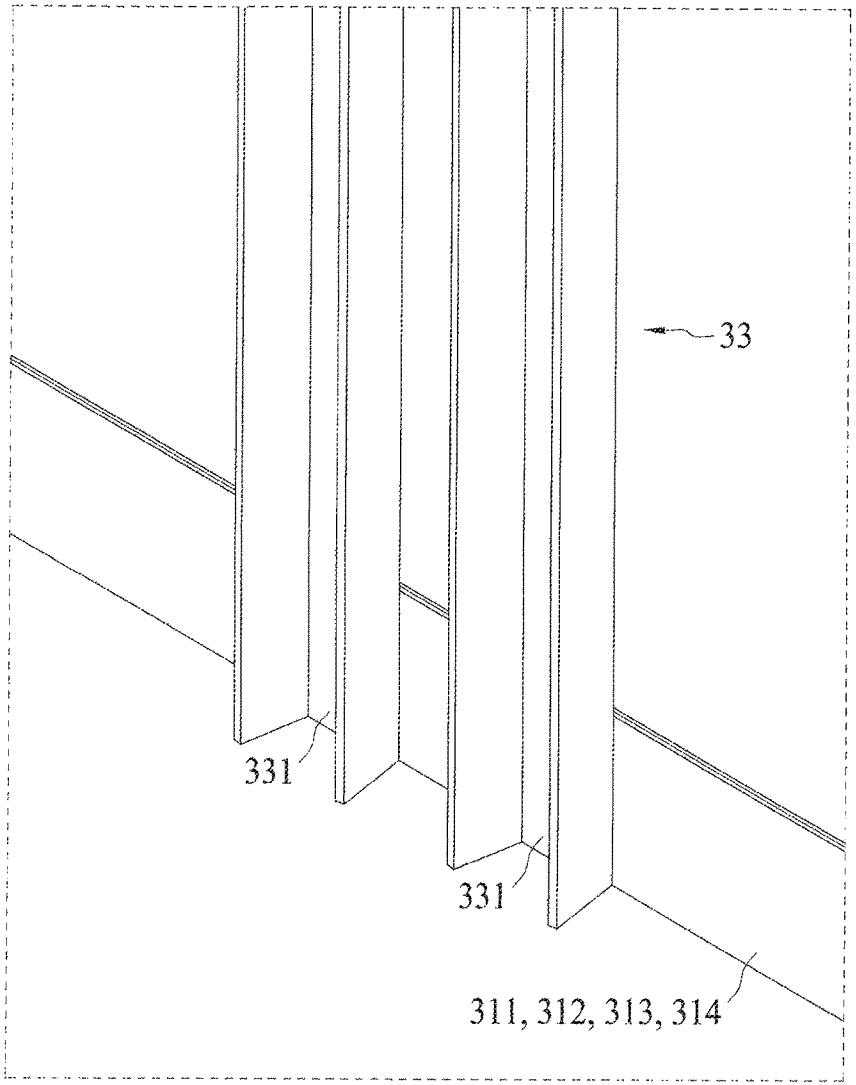
FIG. 5 is an enlarged view of portion "C" shown in FIG. 4.

FIG. 4 is a perspective view of an erecting frame 3 for making a reinforcement cage assembly in accordance with an embodiment of the instant disclosure. In this embodiment, the reinforcement cage assembly made by the erecting frame 3 is used in a waffle slab for a foundry plant. The erecting frame 3 comprises a substantially square frame 31 having a first side 311, a second side 312, a third side 313 and a fourth side 314, wherein the first side 311 and the third side 313 are opposite each other and the second side 312 and the fourth side 314 are opposite each other. A plurality of supports 33 arranged along the first side 311, the second side 312, the third side 313 and the fourth side 314 of the frame 31 and spaced apart from each other, wherein the supports 33 arranged at the first side 311 correspond to the supports 33 arranged at the third side 313, and wherein the supports 33 arranged at the second side 312 correspond to the supports arranged at the fourth side 314. Further, referring to FIG. 5, which is an enlarged view of the "C" portion shown in FIG. 4, each of the supports 33 has two slots 331 which are spaced apart from each other by a distance and generally parallel with each other. In other alternative embodiments, each of the supports has one or more slots 331 therein other than the two slots. As shown in FIG. 4, the erecting frame 3 further comprises a plurality of braces 40 arranged at the first side 311, the second side 312, the third side 313 and the fourth side 314 of the frame 31 and spaced from each other. In the instant embodiment, one end of each brace 40 is fixed to an upper rail 319 of at least one of the four sides of the erecting frame 3 such as the first side 311, the second side 312, or an upper portion of one of the supports 33, such as the supports 33 at the third side 313 and the fourth side 314, and the other end of the each brace 33 is fixed to the ground. Thus, the erecting frame 3 could be fixed on the ground stably.

Figure 6A:
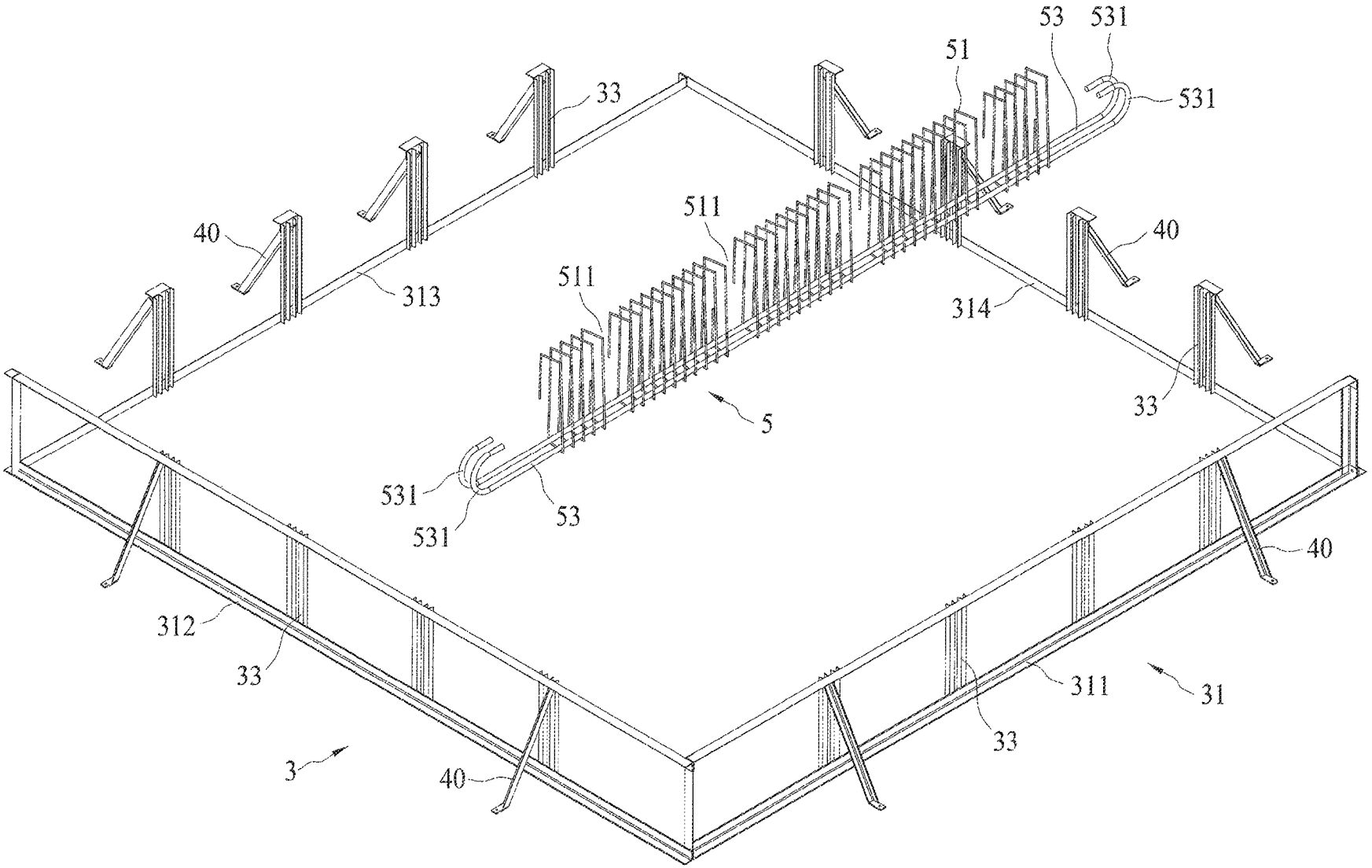
FIGS. 6A-6H are schematic views showing a method of manufacturing a reinforcement cage assembly with the erecting frame in accordance with an embodiment of the instant disclosure.
Figure 6B:
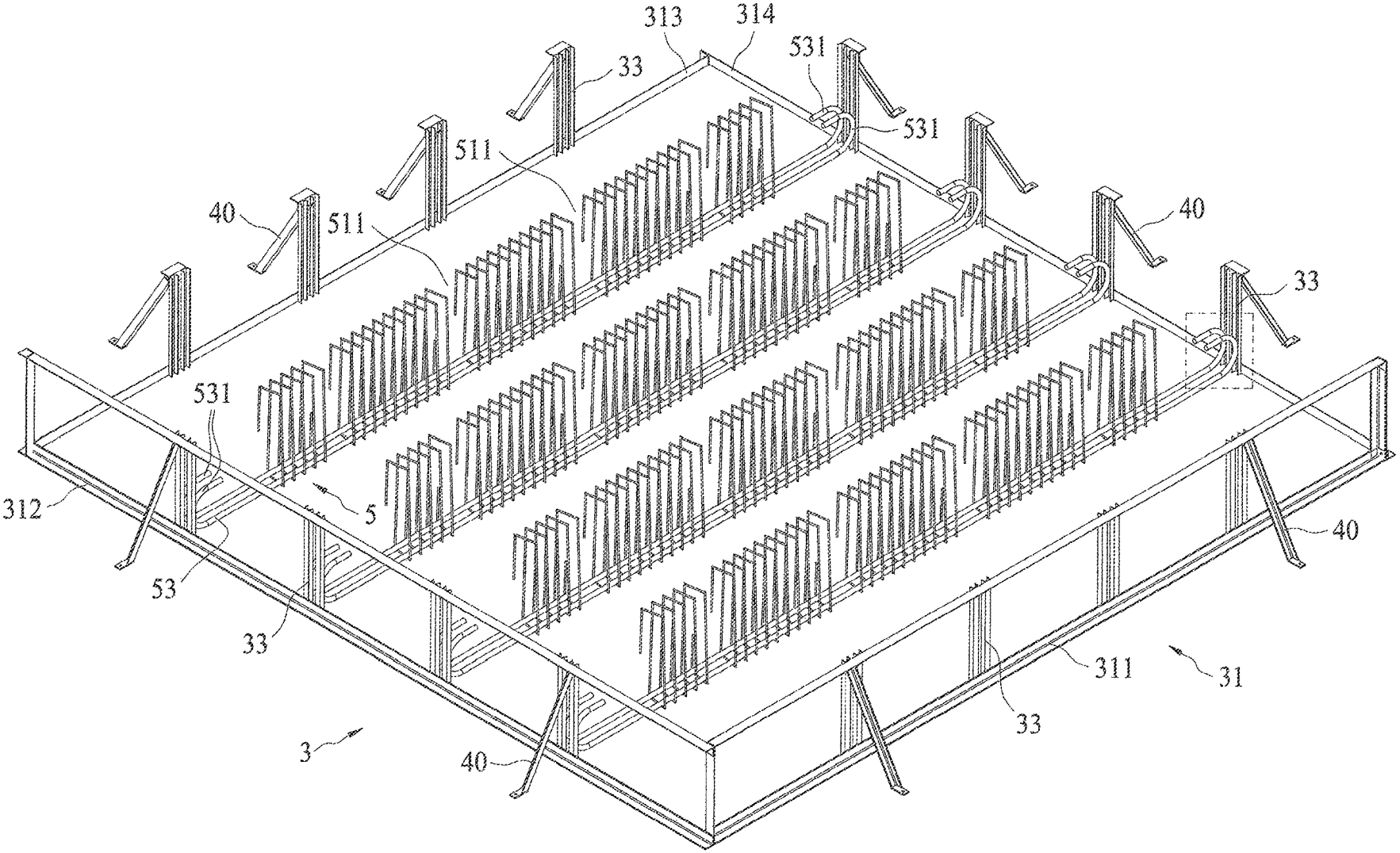
Figure 6C:
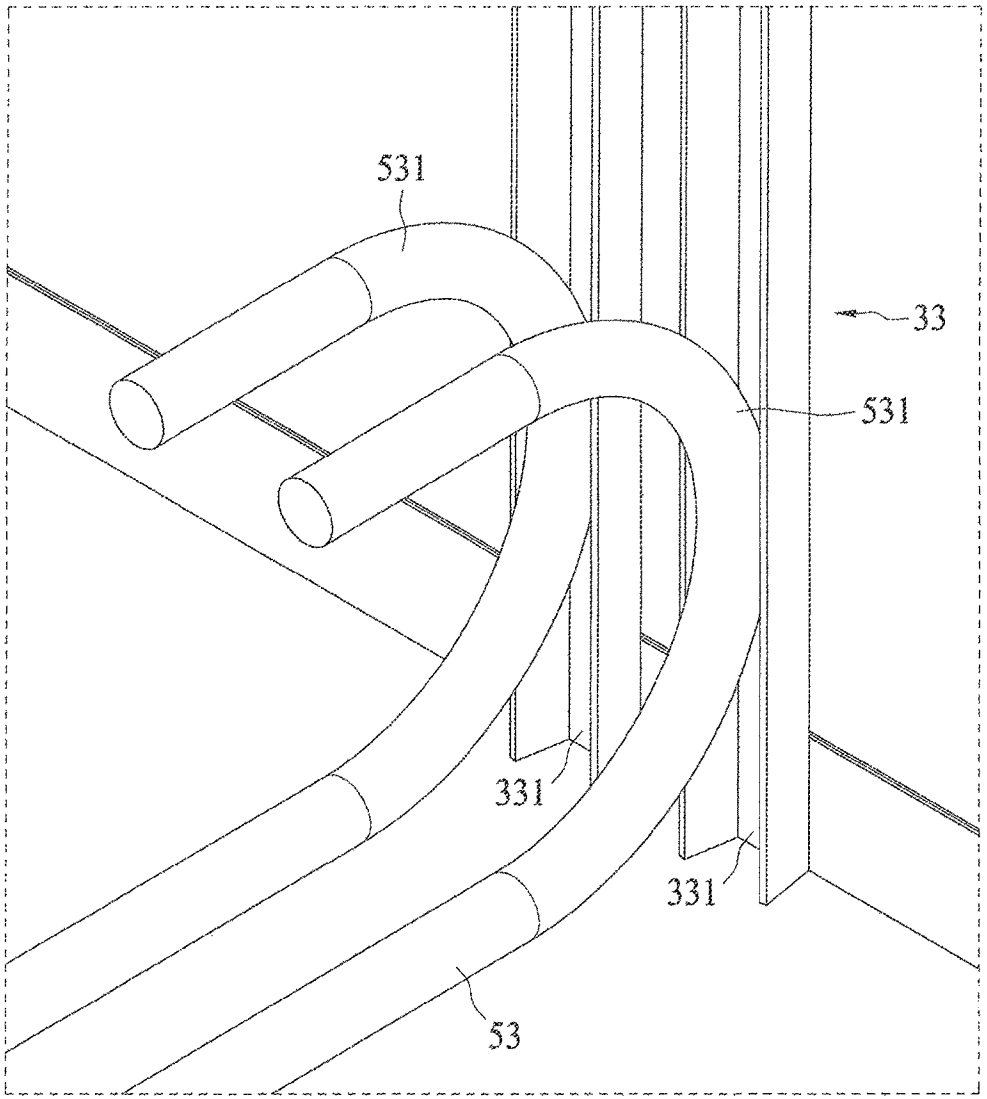

FIGS. 6A-6H are schematic views showing a method of manufacturing a reinforcement cage assembly with the erecting frame 3 in accordance with an embodiment of the instant disclosure. FIGS. 6A and 6B show that a plurality of first reinforcement cages 5 are disposed in the erecting frame 3. With respect to the embodiment, each of the first reinforcement cages 5 has two bottom main bars 53 and a plurality of spiral stirrups 51 fixed to the bottom main bars 53, wherein each bottom main bar 53 has two curved ends 531 and wherein reserved gaps 511 are provided between the spiral stirrups 51. Referring to FIGS. 6A and 6B, when the first reinforcement cages 5 are disposed in the erecting frame 3, two curved ends 531 of the main bar 53 of the first reinforcement cage 5 are respectively disposed into the slots 331 of the supports 33 disposed at the second side 312 and the fourth side 314 (see FIG. 5C). Thus, the first reinforcement cages 5 are disposed within the erecting frame 3 and substantially parallel to the first side 311 or the third side 313 of the erecting frame 3.

Figure 6D:
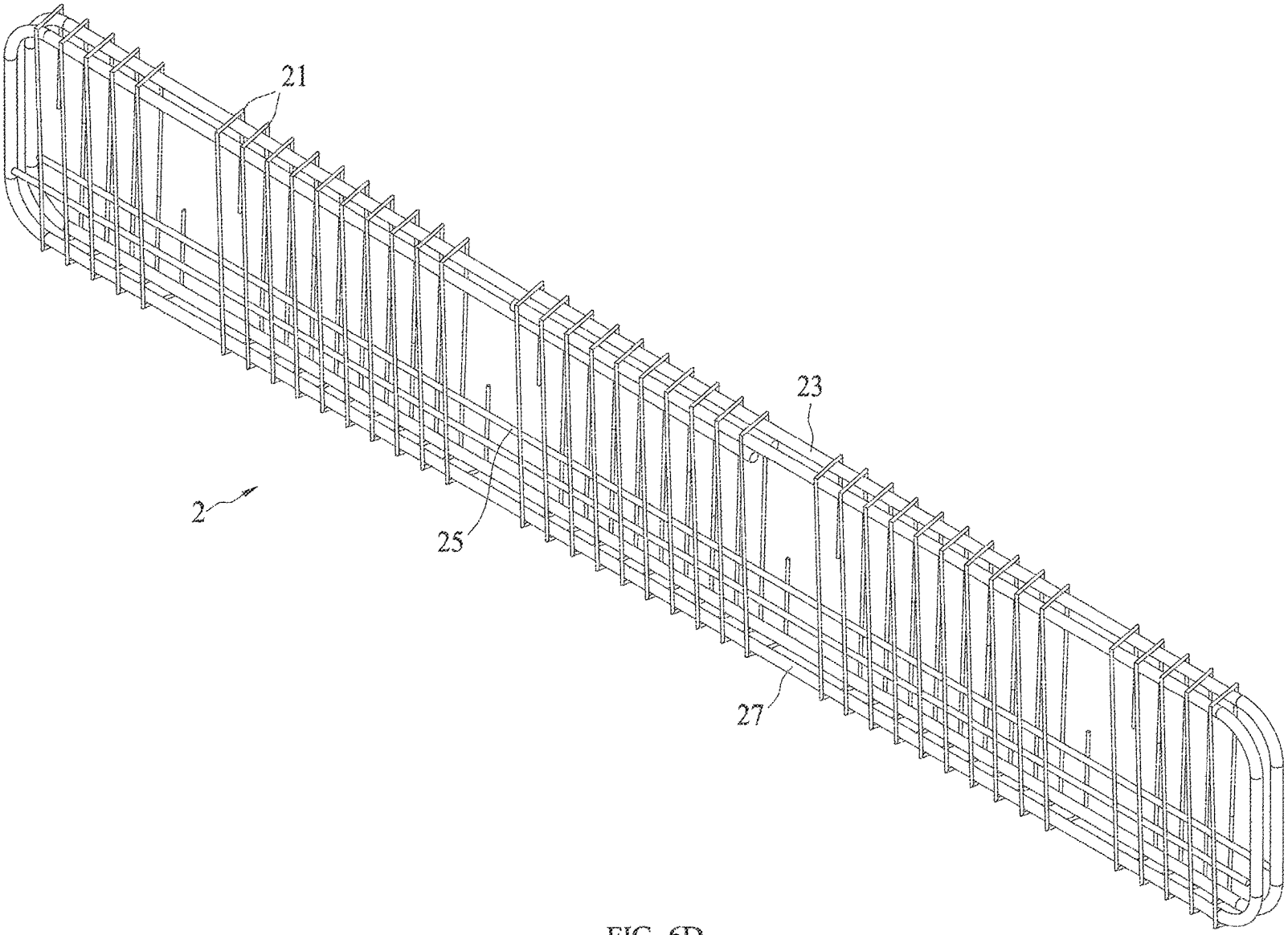
Figure 6E:
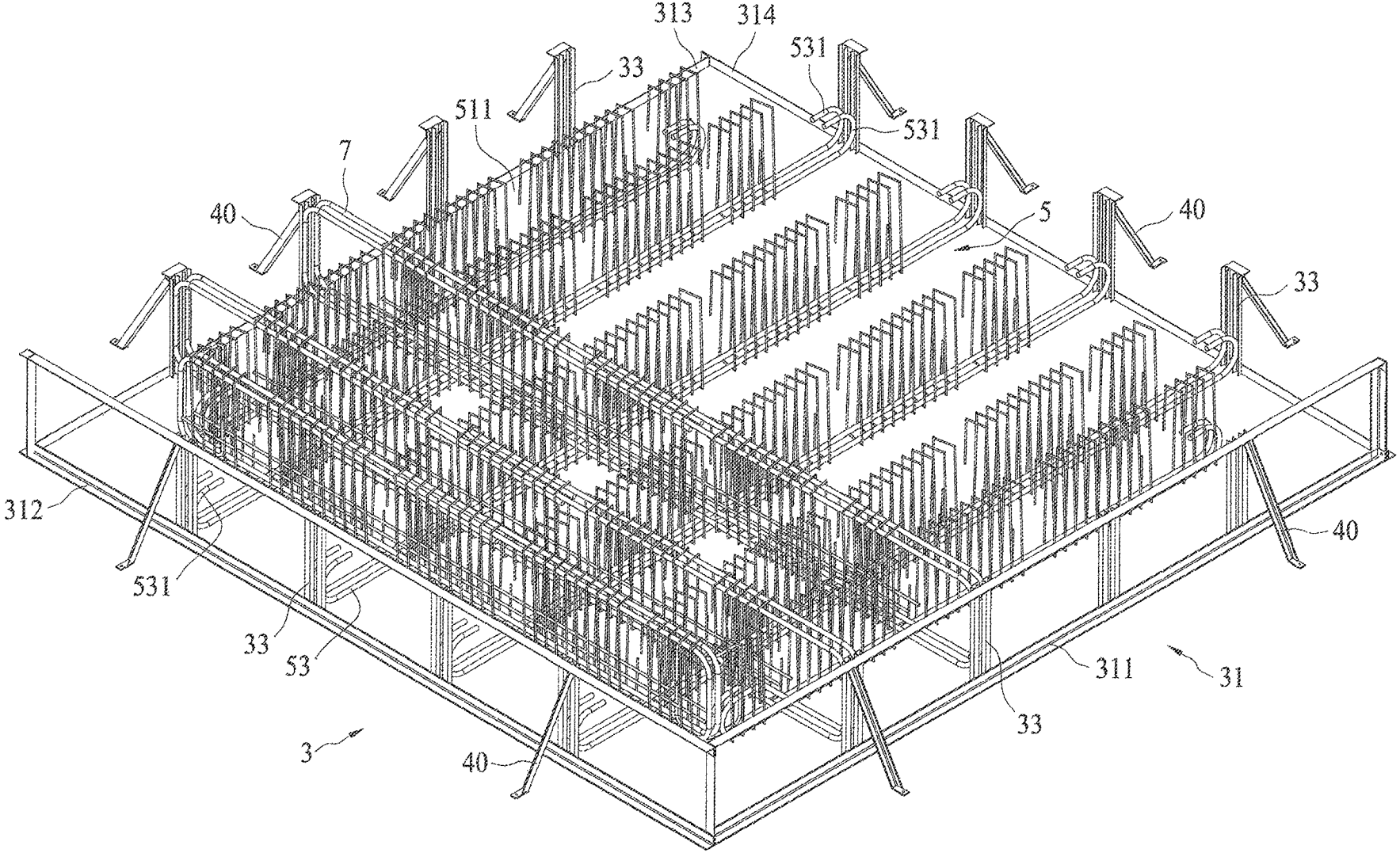
Figure 6F:
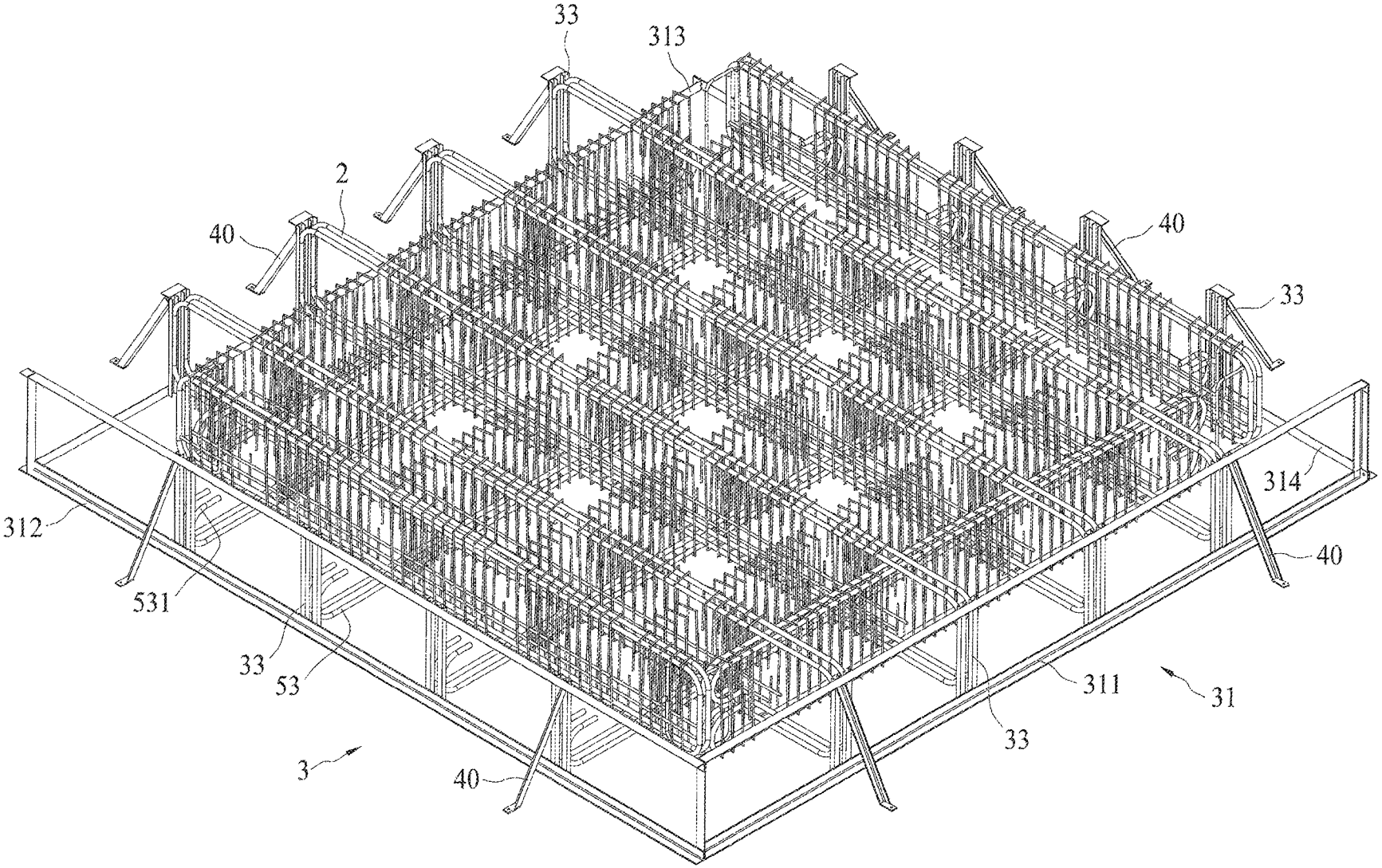

FIG. 6D shows the structures of a second reinforcement cage 2, and FIG. 6E shows that a plurality of second reinforcement cages 2 are disposed in the erecting frame 3. In this embodiment, each second reinforcement cages 2 has at least one spiral stirrup 21, a first main bar 23, a second main bar 27 and tie bars 25, wherein the spiral stirrup 21, a first main bar 23, a second main bar 27 and tie bars 25 are bound together with wires or through welding. In addition, the ends of the first main bar 23 and the at least one second main bar 27 are loop-shaped. Referring to FIGS. 6E and 6F, when the second reinforcement cages 2 are disposed in the erecting frame 3, these second reinforcement cages 2 are passed through the reserved gaps 511 between the spiral stirrups 51 of the first reinforcement cages 5 and the ends of the first main bar 23 and the second main bar 27 of the second reinforcement cages 2 are disposed into the slots 331 of the supports 33 disposed at the first side 311 and the third side 313. Thus, the second reinforcement cages 2 are disposed within the erecting frame 3 and substantially parallel to the second side 312 or the fourth side 314 of the erecting frame 3, and each of the first reinforcement cages 5 and each of the second reinforcement cages 2 crisscross each other.

Figure 6G:
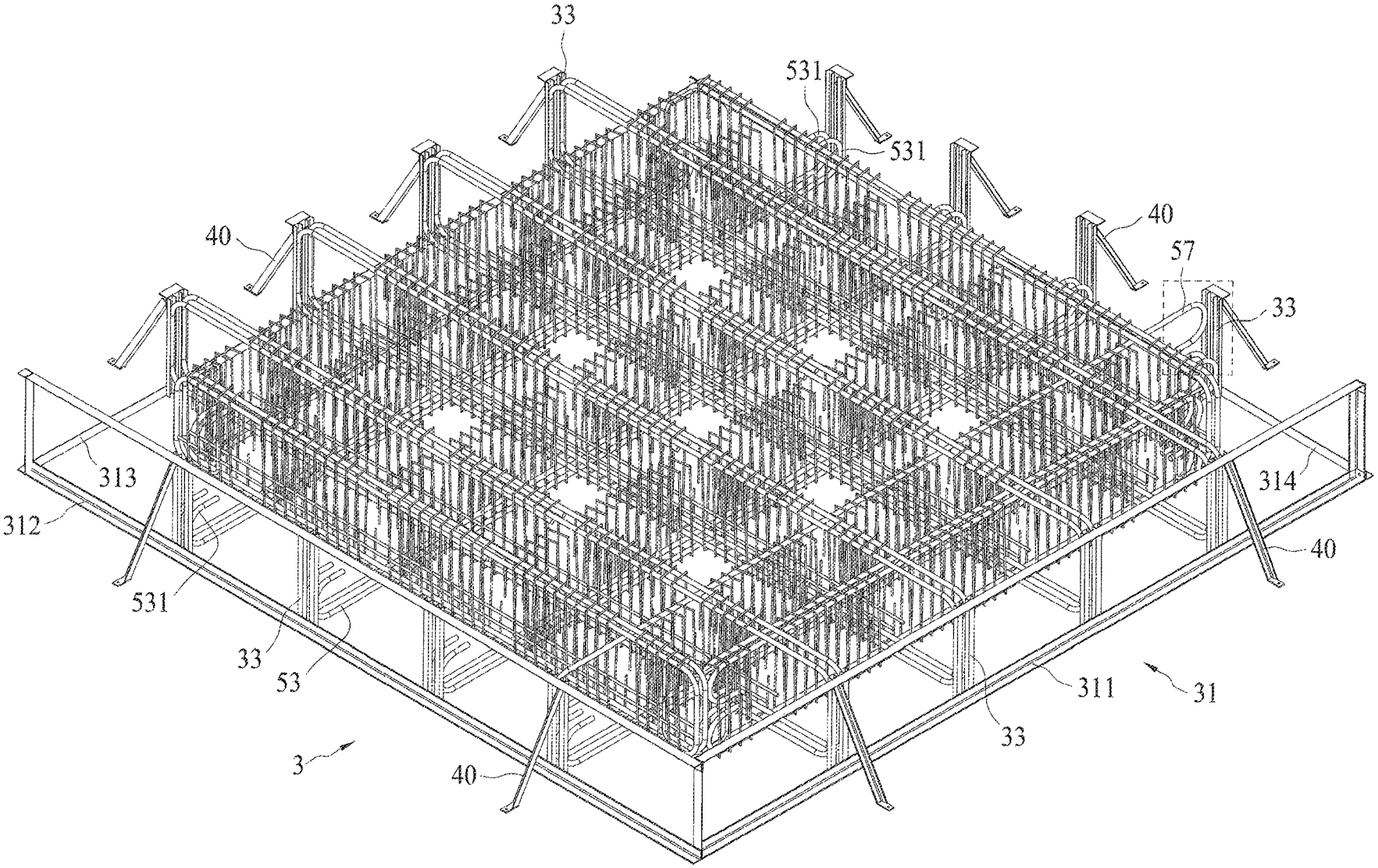
Figure 6H:
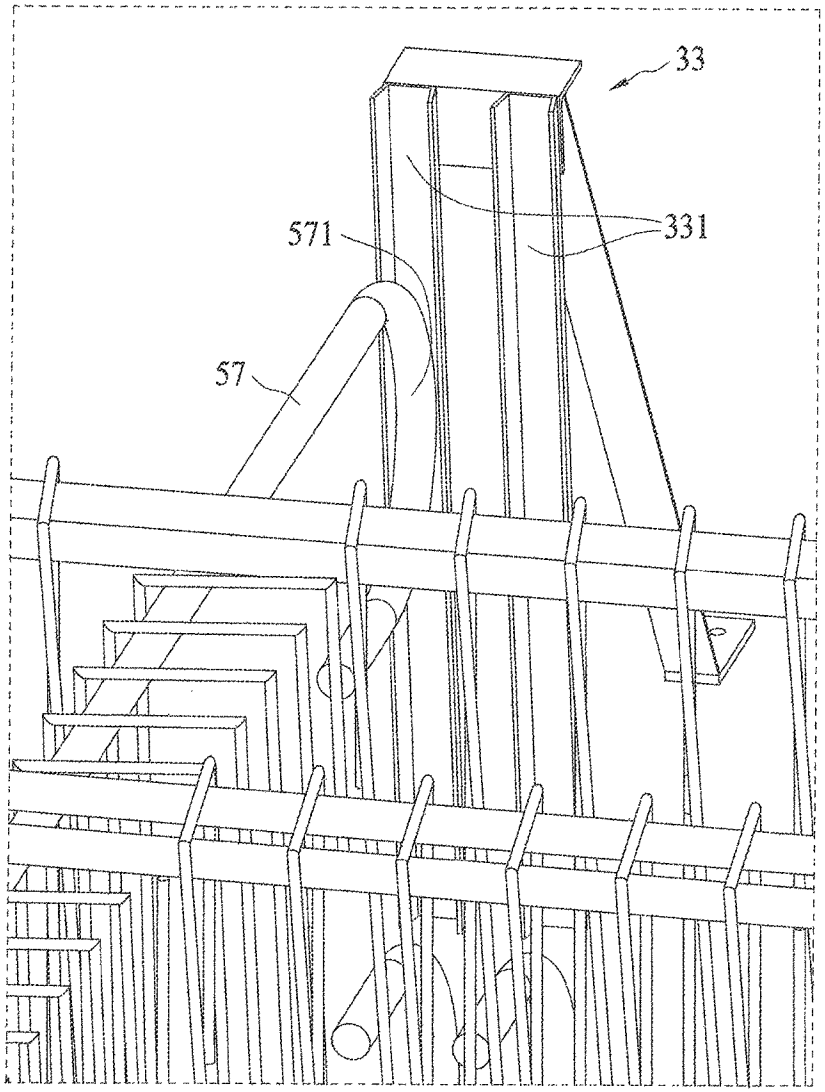

Moreover, as shown in FIGS. 6G and 6H, the user further moves two top main bars 57 such that the top main bars 57 respectively pass through the gaps 339 between the two slots 331 of the supports 33 disposed at the second side 312 or the fourth side 314 and extend into the first reinforcement cages 5. As shown in FIG. 6H, each top main bar 57 has two curved ends 571. After the top main bars 57 have been moved into the first reinforcement cages 5, two curved ends of the top main bar 57 are disposed into the slots 331 of the supports 33 disposed at the second side 312 or the fourth side 314. Then, the user binds the top main bars 57 with the bottom main bars 53 so as to enhance the strength of the first reinforcement cages 5. Thereafter, the user binds the first reinforcement cages 5 with the second reinforcement cages 2 to enhance the rigidity of the reinforcement cage assembly for a waffle slab.

The above embodiments merely describe the principle and effects of the present disclosure, instead of being used to limit the present disclosure. Therefore, persons skilled in the art can make modifications to and variations of the above embodiments without departing from the spirit of the present disclosure. The scope of the present disclosure should be defined by the appended claims.

What is claimed is:

1. A jig for manufacturing a reinforcement cage, comprising:

a base member;

a slot device disposed on the base member and extending along a lengthwise direction of the base member; and a plurality of fasteners arranged on a strip and spaced from each other along the lengthwise direction of the strip, wherein the strip is received in the slot device and is slidable within a predetermined range; and an elongated support arranged beside and above the slot device and generally parallel to the lengthwise direction of the slot device;

wherein the plurality of fasteners are a plurality of hooks.

2. The jig of claim 1 further comprising a stopper disposed on the base member and adjacent to one end of the slot device.

3. The jig of claim 2, wherein one end of the elongated support is fixed to the stopper and the other end of the elongated support is fixed to the base member with a post.

4. The jig of claim 1 further comprising a plurality of pivoting members, which are rotatably mounted on the base member and spaced from each other along the lengthwise direction of the base member such that steel bars disposed on the slot device are capable of sliding along the lengthwise direction of the slot device.

5. The jig of claim 4, wherein the slot device has plural pairs of recesses for transversely receiving the pivoting members wherein each pair of recesses are disposed at two sides of the strip.

6. The jig of claim 5, wherein the each of the pivoting members has a pivot axle and two pivoting bases provided at two ends of the pivoting members respectively, and wherein the pivoting bases are disposed on the base member and two ends of the pivot axle are pivotably received in the two pivoting bases.

7. A method for making a reinforcement cage, comprising:

providing a jig of claim 6;

providing a spiral stirrup on the slot device so that an edge of the spiral stirrup abuts against the elongated support;

sliding the fasteners until each bottom of the spiral stirrup is engaged with each of the fasteners;

providing at least one first main bar; and moving the first main bar through the pivoting members, from one end of the slot device that is near the post to the end that is near the stopper along the lengthwise direction of the slot device so that the first main bar passes through a central space of the spiral stirrup.

8. The method of claim 7, further comprising:

providing at least one second main bar;

moving the second main bar through the pivoting members, from one end of the slot device that is near the post to the end that is near the stopper along the lengthwise direction of the slot device so that the second main bar passes through the central space of the spiral stirrup and is positioned beside the first main bar; and binding the at least one first main bar, the at least one second main bar and the spiral stirrup together.

9. The method of claim 8, further comprising:

providing at least one tie bar;

moving the at least one tie bar from one end of the slot device that is near the post to the end that is near the stopper along the lengthwise direction of the slot device so that the at least one tie bar passes through a central space of the spiral stirrup; and binding the at least one tie bar with the spiral stirrup.

10. The method of claim 9, wherein the at least one first main bar and the at least one second main bar are loop-shaped.

11. An erecting frame for making a reinforcement cage assembly, comprising:

a substantially square frame having a first side, a second side, a third side and a fourth side, wherein the first side and the third side are opposite each other and the second side and the fourth side are opposite each other;

a plurality of supports arranged along the four sides of the frame and spaced apart from each other; and a plurality of braces arranged at the four sides of the frame and spaced from each other, and wherein one end of each brace is fixed to an upper portion of one of the four sides or an upper portion of one of the supports and the other end of the each brace is fixed to the ground;

wherein the supports arranged at the first side correspond to the supports arranged at the third side, and wherein the supports arranged at the second side correspond to the supports arranged at the fourth side;

wherein each of the supports has at least one slot therein for receiving and fixing one end of a main bar of a reinforcement cage of the reinforcement cage assembly.

12. The erecting frame of claim 11, wherein each of the plurality of supports has two slots spaced apart from each other by a distance and generally parallel with each other.

13. A method for making a reinforcement cage assembly, comprising:

providing the erecting frame of claim 11;

providing a plurality of first reinforcement cages, wherein each of the first reinforcement cages has at least one bottom main bar and a plurality of spiral stirrups fixed to the bottom main bar, and wherein the at least one bottom main bar has curved ends and reserved gaps are provided between the spiral stirrups; and respectively disposing two curved ends of the bottom main bar of the first reinforcement cages into the slots of the supports disposed at the second side and the fourth side, such that each of the first reinforcement cages are disposed within the erecting frame and substantially parallel to the first side or the third side.

14. The method of claim 13, further comprising:

providing a plurality of second reinforcement cages manufactured by the method of claim 10; and respectively disposing two ends of the second reinforcement cages into the slots of the supports disposed at the first side and the third side;

wherein the second reinforcement cages are placed in the reserved gaps of the first reinforcement cages, such that each of the second reinforcement cages is disposed within the erecting frame and substantially parallel to the second side or the fourth side and each of the first reinforcement cages and each of the second reinforcement cages crisscross each other.

15. The method of claim 14, further comprising:

providing a plurality of top main bars used for the plurality of first reinforcement cages;

binding the top main bars with at least one of the bottom main bars or the plurality of spiral stirrups; and binding the plurality of first reinforcement cages with the plurality of second reinforcement cages.

* * * * *